US005710095A

United States Patent [19]

Horsten et al.

[11] Patent Number: 5,710,095

[45] Date of Patent: Jan. 20, 1998

[54] DIRECT THERMAL IMAGING METHOD USING A PROTECTED HEAT-SENSITIVE RECORDING MATERIAL

[75] Inventors: Bartholomeus Cyriel Horsten, Rumst; Guy Denis Jansen, Borsbeek; Ronald Schuerwegen, Schelle; Marc Irene Van Damme, Heverlee; Luc Herwig Leenders, Herentals, all of Belgium

[73] Assignee: Agfa-Gevaert, Mortsel, Belgium

[21] Appl. No.: 637,750

[22] PCT Filed: Nov. 6, 1993

[86] PCT No.: PCT/EP93/03121

§ 371 Date: May 2, 1996

§ 102(e) Date: May 2, 1996

[87] PCT Pub. No.: WO95/12495

PCT Pub. Date: May 11, 1995

[51] Int. Cl.[6] ..... B41M 5/28

[52] U.S. Cl. ..... 503/210; 430/338; 430/567; 430/608; 430/619; 503/202; 503/226

[58] Field of Search ..... 428/195, 913, 428/914; 430/338, 567, 608, 619; 503/202, 210

[56] References Cited

U.S. PATENT DOCUMENTS

| | | | |
|---|---|---|---|
| 3,107,174 | 10/1963 | Wartman | 503/210 |
| 4,741,992 | 5/1988 | Przezdziecki | 430/523 |
| 5,424,182 | 6/1995 | Horsten et al. | 430/617 |

FOREIGN PATENT DOCUMENTS

| | | | |
|---|---|---|---|
| 0502562 | 9/1992 | European Pat. Off. | 430/195 |
| 0528074 | 2/1993 | European Pat. Off. | 503/227 |
| 1263078 | 10/1989 | Japan | 503/226 |
| 2000566 | 1/1990 | Japan | 503/201 |

*Primary Examiner*—Bruce H. Hess

*Attorney, Agent, or Firm*—Brumbaugh, Graves, Donohue & Raymond

[57] ABSTRACT

A recording material comprising on the same side of a support, called the heat-sensitive side, (1) one or more layers comprising an imaging composition essentially consisting of (i) a substantially light-insensitive organic silver salt being in thermal working relationship with (ii) a reducing agent, and (2) at said same side covering said imaging composition a protective later, characterized in that said protective layer mainly comprises an organic thermosetting or moisture-hardened polymer or an organic thermosetting or moisture-hardened polymer composition.

14 Claims, No Drawings

DIRECT THERMAL IMAGING METHOD USING A PROTECTED HEAT-SENSITIVE RECORDING MATERIAL

BACKGROUND OF THE INVENTION

1. Field of the invention

The present invention relates to a recording material suited for use in direct thermal imaging. More in particular the present invention relates to a recording material based on a heat induced reaction between a substantially light-insensitive organic silver salt and a reducing agent.

2. Background of the Invention

In thermography two approaches are known:

1. Direct thermal formation of a visible image pattern by imagewise heating of a recording material containing matter that by chemical or physical process changes colour or optical density.
2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions of incorporated dye is transferred onto a contacting receiver element by the application of heat in a pattern normally controlled by electronic information signals.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 in thermal printing operating with a thermal head image signals are converted into electric pulses and then through a driver circuit selectively transferred to the thermal printhead. The thermal printhead consists of microscopic heat resistor elements, which convert the electrical energy into heat via the Joule effect. The electric pulses thus converted into thermal signals manifest themselves as heat transferred to the surface of the thermal recording material wherein the chemical reaction resulting in colour development takes place.

The optical density of transparencies produced by thermal transfer of dyes or dye forming ingredients is rather low and in most of the commercial systems—in spite of the use of donor elements specially designed for printing transparencies—only reaches 1 to 1.2 (as measured by a Macbeth Quantalog Densitometer Type TD 102). However, for many application fields a considerably higher transmission density is asked for. For instance in the medical diagnostical field a maximal transmission density of at least 2.5 is desired.

High optical densities can be obtained using a recording material comprising on a support a heat-sensitive layer comprising a substantially light-insensitive organic silver salt and a reducing agent. Such recording material can be image-wise heated using a thermal head causing a reaction between the reducing agent and the substantially light-insensitive organic silver salt leading to the formation of a black image containing metallic silver. To obtain a good thermosensitivity heating is carried out by contacting the thermal head with the heat-sensitive layer. The density level may be controlled by varying the amount of heat applied to the recording material. This is generally accomplished by controlling the number of heat pulses generated by the thermal head. An image having a grey scale is thus obtained.

Because said recording material can yield a high-density image it is in principle suitable for use in medical diagnosis.

However, it has been found that image deformations occur due to friction problems between the thermal head and the recording material. This problem could be solved by providing a lubricant e.g. a silicone oil in or on top of the heat-sensitive layer.

But even with the use of a lubricant uneveness of density arises in a number of successively printed images in which also white lines appear in areas that have to be completely black.

3. Summary of the Invention

It is an object of the present invention to improve the quality of images obtained by direct thermal imaging of a recording material comprising on a support in thermal working relationship (i) a substantially light-insensitive organic silver salt and (ii) a reducing agent.

A further object of the present invention is to provide a thermosensitive recording material suited for use in direct thermal imaging, wherein said material has in its structure a protective layer making that when said material is moved into contact with an imagewise energized heating element it does not stick thereto, and does not substantially soil the heating element, avoiding thereby image deformation and damage.

Other objects and advantages of the present invention will become clear from the further description.

According to the present invention there is provided a method of recording an image by image-wise heating a recording material, said recording material comprising on the same side of a support, called the heat-sensitive side, (1) one or more layers comprising an imaging composition essentially consisting of (i) a substantially light-insensitive organic silver salt being in thermal working relationship with (ii) a reducing agent, and (2) at said same side covering said imaging composition a protective layer, characterized in that the image-wise heating proceeds with a thermal head contacting said heat-sensitive side and through said protective layer mainly comprising a cured polymer or cured polymer composition.

By "thermal working relationship" is meant here that said substantially light-insensitive organic silver salt and said reducing agent by means of heat can react to form metallic silver. For that purpose said ingredients (i) and (ii) may be present in a same layer or different layers wherefrom by heat they can come into reactive contact with each other e.g. by diffusion or mixing in the melt. A heat-sensitive recording material containing silver behenate and 4-methoxy-1-naphthol as reducing agent in adjacent binder layers is described in Example 1 of U.S. Pat. No. 3,094,417.

Further in accordance with the present invention a thermal recording material is provided, which recording material comprises on the same side of a support, called the heat-sensitive side, (1) one or more layers comprising an imaging composition essentially consisting of (i) a substantially light-insensitive organic silver salt being in thermal working relationship with (ii) a reducing agent, and (2) at said same side covering said imaging composition a protective layer, characterized in that said protective layer mainly comprises (at least 50% by weight) a cured polymer or cured polymer composition.

DETAILED DESCRIPTION OF THE INVENTION

Curing or hardening of the protective layer is based on chemical crosslinking of polymer chains resulting in a three-dimensional structure with improved mechanical strength.

Curing or hardening of polymers may be accelerated by heat. When crosslinking is initiated or speeded up by heat so-called thermosetting polymers are used. Examples of thermosetting polymers can be found in the book "Synthetic High Polymers" by CT Greenwood and W Banks—Oliver & Boyd Edinburgh (1968), p. 120–127 referring to phenolic resins, amino resins, unsaturated polyester resins, epoxy resins and polyurethane resins. Thermosetting vinyl and acrylic copolymers are described by D. H. Solomon in "The Chemistry of Organic Film Formers"—John Wiley & Sons, Inc. New York (1967), p. 251–279.

When using a thermosetting resin or resin composition for producing a protective layer on a heat-sensitive recording material care should be taken that the setting temperature is sufficiently below the temperature at which optical density in the recording layer reaches an unacceptable fog level. Therefore, preference is given to chemical crosslinking that proceeds sufficiently fast at room temperature (about 20° C.).

The cured polymers or resins may provide a hydrophobic (water-repellant) or hydrophilic (by water-moistenable) character to the protective layer.

A hydrophilic character is advantageous in that it has been experimentally stated by us that in long run printing less dirt deposits on the thermal printing head which obtains a hydrophobic character by use of a lubricant also called slipping agent, e.g. silicone oil.

In case said protective layer contains hydrophilic polymers having active hydrogen atoms at least part of them has reacted with hardening agents selected from the group consisting of polyisocyanates, polyepoxides, aldehydes and hydrolysed tetraalkyl orthosilicates.

Preferred hydrophilic polymers cured with said hardening agents are selected from the group consisting of polyvinyl alcohol, partially hydrolised polyvinyl acetate, preferably the totality of acetate groups is hydrolysed for at least 20%, and gelatin.

In order to have film-forming properties these polymers have preferably a weight average molecular weight of at least 20000 g/mol, more preferably of at least 30000 g/mol.

According to a particularly preferred mode the protective layer of a recording material for use according to the present invention is mainly composed of a hydrolysed polyvinyl acetate hardened with a hydrolysed tetraalkyl orthosilicate.

A crosslinking reaction for forming three-dimensional polymer structures and that requires no additional heat is preferably based on radiation-curing by which is meant that ultraviolet (UV) or electron beam (EB) radiation is used to produce chemically active substances, such as chemical radicals that initiate and propagate three-dimensional addition polymerization of monomers and/or pre-polymers.

According to another photo-curing technique catalysts are produced photo-chemically, e.g. acids that speed up a chemical crosslinking reaction in such a degree that one can speak of cold-setting. The latter technique is often used in the production of photo-resists.

The crosslinking proceeds e.g. between reactive polymer chains and optionally with the aid of preferably low molecular weight polyfunctional crosslinking agents either or not in the presence of a catalyst.

According to a first embodiment involving photo-curing said protective layer is formed from a layer comprising addition polymerizable monomers and/or pre-polymers at least part of which is polyfunctional in admixture with a photoinitiator wherefrom on irradiation with UV radiation free radicals are formed that activate a polymerization chain reaction. By the presence of polyfunctional addition monomers photocross-linking and consequently resin-curing takes place. Useful photopolymerizable monomers are e.g. ethylenically unsaturated compounds having a vinyl or vinylidene group examples of which are described in the already mentioned book "Imaging Systems" by Kurt I. Jacobson-Ralph E. Jacobson, Chapter X under the heading "Polymeric Systems".

According to the type of monomers and pre-polymers being water soluble or water-insoluble the coating proceeds from aqueous or organic liquid medium or mixtures of both.

A suitable water-soluble monomer capable of forming a UV-cured resin layer is N,N'-methylenebisacrylamide. In water dispersable monomers having polyfunctional α,B ethylenic unsaturation, e.g. di- or trifunctional acrylate moieties, may be used likewise.

Water thinnable and emulsion acrylate functional oligomers are commercially available, e.g. under the tradenames ACTOCRYL WB600B, ANCOMER LPX 1099, CRAYNOR CN 435, CRAYNOR CN 445 W55, CRAYNOR CN 455 W55, EBECRYL 554W, EBECRYL 740W, LAROMER LR 8576, LAROMER LR 8585, LAROMER PE 55W, PHOTOMER 4047, PHOTOMER 6158, PHOTOMER 7042, PHOTOMER 7053, and PHOTOMER 7064.

An example of a suitable water-insoluble monomer capable of forming a UV-cured resin is pentaerythritol tetraacrylate which may be used in admixture with methyl methacrylate in a solvent comprising methylene chloride, ethyl acetate and methyl ethyl ketone.

Particularly suitable for forming UV-cured resin layers with high mechanical strength are formed from at least one monomer within the scope of a following general formula (I) or (II):

$$A[-NHCO-X-L^1(-(L^2)_u-OCO-CR^1=CH_2)_n]_m \qquad (I)$$

wherein n represents an integer from 1 to 3, m equals an integer of 3 to 6 when n equals 1, and 2 to 6 when n equals 2 or 3, and u equals 0 or 1;

A represents an organic group of the following nature being 3 to 6 valent when n equals 1 and being 2 to 6 valent when n equals 2 or 3:

a) a hydrocarbon residue containing 5 to 25 carbon atoms which may be interrupted by one or more ether, ester or amide functions;

b) $A^1[-(\underset{R^3}{\underset{|}{O}}CH-\underset{R^4}{\underset{|}{C}}H)_o-OCONH-A^2-]_p-$ with $A^1$ representing a linear or branched aliphatic residue that may contain 0 to 3 O-atoms and 2 to 20 C-atoms, an aromatic residue containing 6 to 24 carbon atoms, an aromatic aliphatic residue containing 7 to 28 C-atoms or an cycloaliphatic residue containing 6 to 26 C-atoms, $R^3$ and $R^4$ each independently representing a hydrogen or a methyl group, $A^2$ representing an aromatic, aliphatic or cycloaliphatic hydrocarbon residue containing 5 to 25 carbon atom, o represents an integer of 0 to 5 and p represents an integer of 2 to 6 when n equals 2 or 3 and represents an integer of 3 to 6 when n equals 1;

c) $A^1[-(\underset{R^3}{\underset{|}{O}}CH-\underset{R^4}{\underset{|}{C}}H)_o-OCO-A^2-]_p-$ wherein $A^1$, $A^2$, $R^3$, $R^4$, o and p have the same meaning as defined above d) $A^1[-(OCH-CH)_o-(G-Q)_r-]_p-$
$\quad\quad\quad Examples of suitable prepolymers for use in an UV-curable composition applied according to the present invention are the following:

unsaturated polyesters, e.g. polyester acrylates; urethane modified unsaturated polyesters, e.g. urethane-polyester acrylates. Further are mentioned polyfluorinated resins having acrylate functionality described in published European patent application (EP-A) 0 501 072. Liquid polyesters having an acrylic group as a terminal group, e.g. saturated copolyesters which have been provided with acryltype end groups are described in published EP-A 0 207 257 and *Radiat. Phys. Chem.*, Vol. 33, No. 5, 443–450 (1989). The latter liquid copolyesters are substantially free from low molecular weight, unsaturated monomers and other volatile substances and are of very low toxicity (ref. the periodical "Adhäsion" 1990 Heft 12, page 12). The preparation of a large variety of radiation-curable acrylic polyesters is given in German Offenlegungsschrift No. 2838691. Mixtures of two or more of said prepolymers may be used.

A survey of UV-curable coating compositions is given e.g. in the periodical "Coating" 9/88, p. 348–353. In that connection further reference is made to the book "Chemistry & Technology of UV and EB formulation for coatings, inks & paints—Volume 2: "Prepolymers and reactive diluents for UV and EB curable formulations" by N. S. Allen, M. A. Johnson, P. K. T. Oldring, M. S. Salim, published by SITA Technology Lts. London (ISBN 0 947798 10 2).

Protective abrasion-resistant topcoats can be obtained likewise by the use of prepolymers also called oligomers of the class of aliphatic and aromatic polyester-urethane acrylates. The structure of polyester-urethane acrylates is given in the booklet "Radiation Cured Coatings" by John R. Constanza, A. P. Silveri and Joseph A. Vona, published by Federation of Societies for Coatings Technology, 1315 Walnut St. Philadelphia, Pa. 19107 USA (June 1986) p. 9.

The structure of particularly useful aromatic polyester-urethane acrylate prepolymers is illustrated by following general formula:

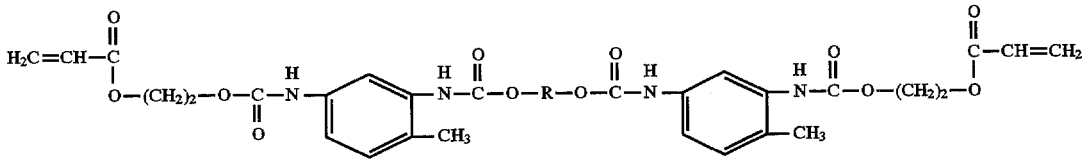

wherein R is a C2 to C6 alkylene group.

In the synthesis of said aromatic urethane first tolylene 2,4-diisocyanate is used in a polyaddition reaction with aliphatic diols and the polymerizable double bond end structures are introduced by reaction of terminal isocyanate groups with 2-hydroxyethyl acrylate. In the synthesis of aliphatic urethane acrylates an alkylene diisocyanate is used, e.g. 1,6-diisocyanatohexane.

Examples of the preparation of aliphatic polyester-urethane acrylates, are given in U.S. Pat. No. 4,983,505 and in DE 2530896.

The introduction of a plurality of acrylic double bonds per polymer chain of the prepolymer proceeds by first effecting a partial esterification of a polyol, e.g. pentaerythritol, with acrylic acid and a subsequent reaction of the still free HO-group(s) of the polyol with a polyfunctional isocyanate.

Examples of free radical polymerizable liquid monomers that preferably serve as solvent or diluent for the prepolymers and therefore are called diluent monomers are the following: methyl (metha)acrylate, ethyl acrylate, butyl acrylate, 2-ethylhexyl methacrylate, 2-hydroxyethyl acrylate, 2-hydroxyethyl methacrylate, glycidyl methacrylate, n-hexyl acrylate, lauryl acrylate, tetrahydrofurfurylmethacrylate and an aromatic epoxyacrylates.

Mono-functional diluent monomers are not necessarily applied in conjunction with unsaturated prepolymers but can be used to form a radiation-curable composition with good abrasion resistance in conjunction with saturated polyesters, e.g. polyethylene terephthalate and polyethylene isophthalate. Preferred mono-functional monomers for use therewith are methyl methacrylate and tetrahydrofurfuryl methacrylate and aromatic epoxyacrylates.

Examples of suitable di-functional monomers are: 1,6-hexanediol diacrylate, 1,6-hexanediol dimethacrylate, silicone diacrylate, neopentylglycol, 1,4-butanediol diacrylate, ethyleneglycol diacrylate, polyethyleneglycol diacrylate, pentaerythritol diacrylate, divinylbenzene.

A difunctional acrylate e.g. 1,6-hexanediol diacrylate is preferably used as reactive diluent in an amount of between 5 and 80% by weight, preferably between 10 and 30% by weight.

Examples of suitable tri- or more-functional monomers are:

trimethylolpropane triacrylate, trimethylolpropane trimethacrylate, pentaerythritol triacrylate, dipentaerythritol hexaacrylate, an acrylate of ethylenediamine, aliphatic and aromatic urethane acrylates and the monomers according to said above mentioned general formula (I) also described in published European patent application No. 0502562.

Since the radiation-curing is carried out with ultraviolet radiation (UV), a photoinitiator is present preferably in the coating composition to serve as a catalyst to initiate the polymerization of the monomers and their optional cross-linking with the pre-polymers resulting in curing of the coated protective layer composition. A survey of photoinitiators is given in Table 10.3 of the already mentioned book "Imaging Systems" of Kurt I. Jacobson and Ralph E. Jacobson, and in the already mentioned book "Chemistry & Technology of UV & EB formulation for coatings, inks & paints" Volume 3: Photoinitiators for free radical and cationic polymerisation, by K. K. Dietliker, published by SITA Technology Ltd. London (ISBN 0 947798 10 2).

Photoinitiators suitable for use in UV-curable coating compositions belong to the class of organic carbonyl compounds, for example, benzoin ether series compounds such as benzoin isopropyl, isobutylether; benzil ketal series compounds; ketoxime esters; benzophenone series compounds such as benzophenone, o-benzoylmethylbenzoate; acetophenone series compounds such as acetophenone, trichloroacetophenone, 1,1-dichloroacetophenone, dialkoxyacetophenone, hydroxyalkylphenone, aminoalkylphenone, acylphosphine oxide, 2,2-diethoxyacetophenone, 2,2-dimethoxy-2-phenylacetophenone; thioxanthone series compounds such as 2-chlorothioxanthone, 2-ethylthioxanthone; and compounds such as 2-hydroxy-2-methylpropiophenone, 2-hydroxy-4'-isopropyl-2-methylpropiophenone, 1-hydroxycyclohexylphenylketone and 1,2 diketonederivatives. Benzophenone-, thioxanthone- and 1,2-diketonederivatives are preferably used in conjunction with amine-co-initiators.

A particularly preferred photoinitiator is 2-hydroxy-2-methyl-1-phenyl-propan-1-one which product is marketed by E. Merck, Darmstadt, Germany under the tradename DAROCUR 1173.

Other very useful free-radical producing photoinitiator compounds are bisimidazolyl compounds substituted in the 2, 4 and 5-position with aromatic groups e.g. phenyl groups including substituted phenyl groups.

Examples of such compounds are 2,4,5-triphenylimidazolyl dimers consisting of two lophine radicals bound together by a single covalent bond and derivatives thereof described in GB-P 997,396 and U.S. Pat. No. 1,047,569. These photoinitiators are used advantageously in the presence of agents containing active hydrogen atoms, e.g. organic amines, mercaptans and triphenylmethane dyes as set forth e.g. in said GB-P specifications.

A preferred free-radical producing combination contains 2-mercaptobenzoxazole and said 2,4,5-triphenylimidazolyl dimer.

Still other particularly suitable photopolymerization initiators are the oxime esters described in published European patent application 57947.

The above mentioned photopolymerization initiators may be used alone or as a mixture of two or more and optionally in the presence of a photosensitizer for accelerating the effect of the photoinitiator.

Examples of ultraviolet radiation curable compositions suitable for preparing a protective coating in a thermographic recording material according to the present invention are described in U.S. Pat. No. 4,110,187, and in published European patent application 0510753, wherein also a very useful coating technique for producing thin (1 to 25 μm) protective layers based on screen-printing is described. By means of addition polymerizable monomers at least part of which is polyfunctional on irradiation with an electron beam free radicals are formed that activate a chain reaction.

In electron-beam (EB) curable compositions there is no need for a photoinitiator.

Radiation-curing with electron-beam equipment is discussed e.g. in the periodical "Adhäsion" 1990—Heft 12, with a survey of references on p. 40.

The curing of the protective layer provides a high resistance against abrasion together with a desired anti-stick character.

According to a special embodiment the protective layer is made by chemical curing starting from a binder composition hardened under the influence of moisture and prepared by mixing the following components (A) and (B):

(A) 30 to 99 parts by weight of at least one copolymer of olefinically unsaturated compounds having a weight-average molecular weight [Mw] of at least 1500 and containing chemically incorporated moieties capable of undergoing an addition reaction with amino groups, and (B) 1 to 70 parts by weight of organic substances containing blocked amino groups from which substances under the influence of moisture compounds having free primary and/or secondary amino groups are formed, and wherein i) the copolymers of component (A) contain intramolecularly bound carboxylic anhydride moieties, with the anhydride equivalent weight of the copolymers being from 393 to 9,800 and ii) the binder composition contains from 0.25 to 10 anhydride moieties for each blocked amino group.

According to a preferred embodiment the protective layer is made of the following moisture-hardenable composition consisting of:

(A) 50 to 97 parts by weight of (a) copolymer(s) of maleic anhydride with at least one other olefinically unsaturated monomer, said copolymer(s) containing addition polymerized maleic anhydride units and having a weight-average molecular weight (Mw) of 1,500 to 75,000, and (B) 3 to 50 parts by weight of at least one organic substance containing blocked amino groups, said substance having a molecular weight of 86 to 10,000.

Examples of copolymers (A) and substances (B) are given in published European patent application (EP-A) 0 541 146 which has to be read in conjunction herewith.

Other crosslinkable polymers that can be hardened by irradiation with UV-radiation are methacrylamide-modified cellulose esters, e.g. JAYLINK 106E (tradename of Bomar Specialities Company for a modified cellulose butyrate containing acrylamido groups; the degree of substitution by vinyl groups is 0.2).

The protective layer of the direct thermal recording material according to the present invention may in addition to said cured polymers contain one or more of the thermoplastic binders commonly used for heat-resistant layers such as e.g. poly(styrene-co-acrylonitrile), poly(vinyl alcohol-co-butyral), poly(vinyl alcohol-co-acetal), poly(vinyl alcohol-co-benzal), polystyrene, poly(vinyl acetate), cellulose nitrate, cellulose acetate propionate, cellulose acetate hydrogen phthalate, cellulose acetate, cellulose acetate butyrate, cellulose triacetate, ethyl cellulose, poly(methyl methacrylate), and copolymers of methyl methacrylate. The addition of elastomeric block copolymers such as styrene-butadiene-styrene, styrene-isoprene-styrene and poly (styrene-co-acrylonitrile) is preferred. The content of the cured polymers in the protective layer is preferably at least 50% by weight.

The thickness of the protective layer for use in a heat-sensitive recording material according to the present invention is preferably between 1 μm and 10 μm, more preferably between 1.5 μm and 7 μm.

According to a preferred embodiment the friction coefficient of the protective layer is lowered by means of substances that prevent sticking to the thermal head during the image-wise heat recording. For that purpose anti-stick materials such as friction lowering particles are dispersed in the binder matrix of the protective layer. These particles may partially protrude from that layer and may be known matting agents used in silver halide photographic materials. Examples of such friction lowering particles are hard polymethacrylate beads described e.g. in published EP-A 0 483 415 and the spherical polymer beads described in EP 0 080 225. Further are mentioned the friction-lowering particles such as fluorinated polymer particles described in U.S. Pat. No. 4,059,768 which has to be read in conjunction herewith for particulate material having a static friction coefficient at room temperature not higher than 0.30 on steel. Other friction lowering substances are waxes, and colloidal silica.

A survey of waxes suitable for use in a protective layer of a recording material according to the present invention is given in published EP-A 0 554 583.

Other particularly useful additives to the protective layer have cleaning effect on the thermal print head. Substances having that property are inorganic silicate particles. These inorganic silicate particles are salts derived from silica or from silicic acids.

Preferred silicate particles having a mildly abrasive character are i.a. clay, China clay, talc (magnesium silicate), mica, silica, calcium silicate, aluminium silicate, and aluminium magnesium silicate. These particles are incorporated in the protective layer preferably in such a way that at least part of them protrudes.

By the presence of these particles protruding from the surface of the protective layer, said layer has cleaning effect on the thermal printing head in that while slipping along the head they remove any foreign substances adhering to the thermal printing head e.g. dust, binder, and releasing agent, and take them away by holding them within the interstitial spaces between the protruding particles. In this way contamination of the thermal printing head by any such foreign substances is avoided.

The cleaning effect of the inorganic silicate particles is especially appreciated in cases that protective layer carries a separate topcoat called slipping layer comprising a lubricant, e.g. a polydimethylsiloxan-based lubricant.

The inorganic silicate particles for use in the protective layer preferably have an average particle size ranging from 1 to 8 μm and less than 10% by volume of said particles has a size higher than 10 μm. Particles having a size higher than 10 μm obstruct the heat flow, so that the heat generated by the thermal printing head is mainly lost by dissipation.

The particle size of the inorganic silicate particles suited for use in the protective layer according to the present invention may be determined with a Coulter Multisizer II (tradename) having an aperture of 30 μm. A particle having a size of 5 μm (Dynosphere SS-051-P) is used to calibrate the apparatus. The calibration constant is 349.09. The silicate particles are dispersed in an aqueous 0.1N sodium chloride solution comprising a fluorine surfactant before the measurement of the particle size and of the particle size distribution. The measurement is performed for particle sizes ranging from 0.7 to 22.4 μm. The selected siphon mode is 500 μl.

It has been established that talc provides a very good cleaning and lubricating effect. Talc has a Mohs hardness of 1.0 so that it does not abrade the passivation layer of the thermal printhead.

Examples of talc particles that can be used advantageously in accordance with the present invention are i.a.:

- Talc 1: Micro Ace Type P3 having a volume average particle size of 4.5 μm and 1.29% by volume thereof having a size higher than 10 μm (commercially available from Nippon Talc, Interorgana Chemiehandel)
- Talc 2: Mistron Ultramix having a volume average particle size of 3.88 μm and 1.72% by volume thereof having a size higher than 10 μm (commercially available from Cyprus Minerals)
- Talc 3: Micro-talc I.T. Extra having a volume average particle size of 4.33 μm and 2.43% by volume thereof having a size higher than 10 μm (commercially available from Norwegian Talc Minerals)
- Talc 4: Cyprubond (surface-treated to improve adhesion to the binder) having a volume particle size of 5.28 μm and 9.22% by volume thereof having a size higher than 10 μm (commercially available from Cyprus Minerals).
- Talc 5: MP10-52 having a volume particle size of 3.15 μm and 1.26% by volume thereof having a size higher than 10 μm (commercially available from Pfizer Minerals)
- Talc 6: MP12-50 having a volume particle size of 2.60 μm and 0.97% by volume thereof having a size higher than 10 μm (commercially available from Pfizer Minerals)
- Talc 7: Micro-talc A.T. Extra having a volume average particle size of 4.32 μm and 3.76% by volume thereof having a size higher than 10 μm (commercially available from Norwegian Talc Minerals)
- Talc 8: Stellar 600 having a volume average particle size of 5.16 μm and 6.77% by volume thereof having a size higher than 10 μm (commercially available from Norwegian Cyprus Minerals)

Examples of other silicate particles that can be used in accordance with the present invention are i.a.:

- Silicate 1: Syloid 378, which are silica particles having an average particle size of 4 μm and 0.06% by volume thereof having a size higher than 10 μm (commercially available from Grace)
- Silicate 2: Iriodin 111, which are mica particles having an average particle size of 4.42 μm and 1.45% by volume thereof having a size higher than 10 μm (commercially available from Merck)
- Silicate 3: Chlorite, which is a magnesium-aluminium silicate having an average particle size of 5.57 μm and 16.58% by volume thereof having a size higher than 10 μm (commercially available from Cyprus Minerals)

The amount of inorganic silicate particles used in the protective layer generally is in the range of from about 0.1 to 50 wt %, preferably 0.25 to 40 wt % of the binder or binder mixture employed.

The protective layer of the direct thermal recording material according to the present invention may in addition to the inorganic silicate particles comprise or being coated with minor amounts of such other agents like liquid lubricants, solid lubricants, or mixtures thereof.

Examples of suitable lubricating materials are surface active agents with or without a polymeric binder. A surface active agent is an amphiphilic molecule containing an apolar group in conjunction with (a) polar group(s) such as carboxylate, sulfonate, phosphates, aliphatic amine salt, aliphatic quaternary ammonium salt groups, polyoxyethylene alkyl ethers, polyethylene glycol fatty acid esters, and fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters.

Preferred lubricants are polysiloxane-polyether copolymers and derivatives from polydimethylsiloxane commercially availabe e.g. as BYK 070, BYK 306, BYK 307, BYK 310, BYK 320, and BYK 322 (tradenames of Byk Cera, The Netherlands, and further as TEGOGLIDE 410, TEGOMER A SI 2120, and TEGOMER H SI 2311, which are tradenames of Goldschmidt, Germany.

According to a particular embodiment the lubricant or slipping agent is a compound that is chemically linked to at least one of the polymers of the protective layer. For that purpose a slipping agent is used that has one or more chemical groups for polymerization or addition or condensation reaction with chemical groups of at least one of the polymers of the protective layer. Examples of polymerizable slipping agents are silicone (meth)acrylates sold under the tradenames EBECRYL 350, EBECRYL 1360, Si-Dehäsiv VP 1530 (UV-curable) and Si-Dehäsiv VP 1959 (EB-curable) from WACKER-Germany, TEGO silicone acrylates 704, 705, 706, 707, 725 and 726 which are difunctional UV and EB curable reactive slipping agents.

Examples of outermost slipping layers (i.e. anti-sticking layers) are described in EP 138483, EP 227090, U.S. Pat. Nos. 4,567,113, 4,572,860 and 4,717,711 and in published European patent applications 311841 and 0 561 678.

In an example a suitable slipping layer comprises as binder an elastomeric block copolymer, e.g. KRATON D1101 (tradename) for styrene-butadiene-styrene block copolymer, styrene-acrylonitrile copolymer or a styrene-acrylonitrile-butadiene copolymer or such in admixture with a lubricant in an amount of 0.1 to 10% by weight with respect to the binder(s).

Another suitable slipping layer may be obtained by coating a solution of at least one silicon compound and a substance capable of forming during the coating procedure a polymer having an inorganic backbone which is an oxide of a group IVa or IVb element as described in published European patent application 0 554 576.

Other suitable slipping coatings are described e.g. in published European patent applications (EP-A) 0 501 072 and 0 492 411.

A slipping layer may have a thickness of about 0.2 to 5.0 μm, preferably in the range of 0.4 to 2.0 μm.

Substantially light-insensitive organic silver salts particularly suited for use in recording materials according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, and likewise silver dodecyl sulphonate described in U.S. Pat. No. 4,504,575 and silver di-(2-ethylhexyl)-sulfosuccinate described in published European patent application 227 141. Useful modified aliphatic carboxylic acids with thioether group are described e.g. in GB-P 1,111,492 and other organic silver salts are described in GB-P 1,439,478, e.g. silver benzoate and silver phthalazinone, which may be used likewise to produce a thermally developable silver image. Further are mentioned silver imidazolates and the substantially light-insensitive inorganic or organic silver salt complexes described in U.S. Pat. No. 4,260,677.

As binding agent for the heat-sensitive imaging layer preferably thermoplastic water-insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA.

The binder to organic silver salt weight ratio is preferably in the range of 0.2 to 6, and the thickness of the image forming layer is preferably in the range of 5 to 16 μm.

The above mentioned polymers or mixtures thereof forming the binder of the heat-sensitive imaging layer may be used in conjunction with "heat solvents" also called "thermal solvents" or "thermosolvents" improving the penetration of the reducing agent(s) and thereby the reaction speed of the redox-reaction at elevated temperature.

By the term "heat solvent" in this invention is meant a non-hydrolyzable organic material which is in solid state at temperatures below 50° C. but becomes on heating above that temperature a plasticizer for the binder of the layer wherein they are incorporated and possibly act then also as a solvent for at least one of the redox-reactants, e.g. the reducing agent for the organic silver salt. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Suitable organic reducing agents for the reduction of substantially light-insensitive organic silver salts are organic compounds containing at least one active hydrogen atom linked to O, N or C, such as is the case in aromatic di- and tri-hydroxy compounds, e.g. hydroquinone and substituted hydroquinones, catechol, pyrogallol, gallic acid and gallates; aminophenols, METOL (tradename), p-phenylenediamines, alkoxynaphthols, e.g. 4-methoxy-1-naphthol described in U.S. Pat. No. 3,094,417, pyrazolidin-3-one type reducing agents, e.g. PHENIDONE (tradename), pyrazolin-5-ones, indanedione-1,3 derivatives, hydroxytetrone acids, hydroxytetronimides, reductones, and ascorbic acid. Representative compounds suitable for thermally activated reduction of organic silver salts are described e.g. in U.S. Pat. Nos. 3,074,809, 3,080,254, 3,094,417, 3,887,378 and 4,082,901.

Particularly suited organic reducing agents for use in thermally activated reduction of substantially light insensitive silver salts are organic compounds containing in their structure two free hydroxy groups (—OH) in ortho-position on a benzene nucleus as is the case in catechol and polyhydroxy spiro-bis-indane compounds corresponding to the following general formula (RI) which are preferred for use in the recording material according to the present invention:

(RI)

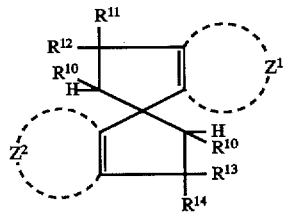

wherein:

$R^{10}$ represents hydrogen or alkyl, e.g. methyl or ethyl, each of $R^{11}$ and $R^{12}$ (same or different) represents H, an alkyl group, e.g. methyl, ethyl or propyl, an alkenyl group or a cycloalkyl group, e.g. cyclohexyl group, or $R^{11}$ and $R^{12}$ together represent the atoms necessary to close a homocyclic non-aromatic ring, e.g. a cylohexyl ring, each of $R^{13}$ and $R^{14}$ (same or different) represents H, an alkyl group, e.g. methyl, ethyl or propyl, an alkenyl group or a cycloalkyl group, e.g. cyclohexyl group, or $R^{13}$ and $R^{14}$ together represent the atoms necessary to close a homocyclic non-aromatic ring, e.g. cyclohexyl, each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

Particularly useful are the polyhydroxy-spiro-bis-indane compounds described in U.S. Pat. No. 3,440,049 as photographic tanning agent, more especially 3,3,3',3'-tetramethyl-5,6,5',6'-tetrahydroxy-1,1'-spiro-bis-indane (called indane I) and 3,3,3',3'-tetramethyl-4,6,7,4', 6',7'-hexahydroxy-1,1'-spiro-bis-indane (called indane II) indane is also known under the name hydrindene.

Preferably the reducing agent is added to the heat-sensitive imaging layer but all or part of the reducing agent may be added to one or more other layers on the same side of the support as the heat sensitive layer. For example, all or part of the reducing agent may be added to the protective surface layer.

In order to avoid the inhibition-effect on free-radical addition polymerisation and curing that may have reducing agents, these agents may be kept separate from the thus curable protective layer by means of a resin layer being not permeable for said reducing agents.

The present heat-sensitive recording material may contain auxiliary reducing agents having poor reducing power in addition to the main reducing agent described. These agents are preferably incorporated in the heat-sensitive layer containing the organic silver salt. For that purpose sterically hindered phenols are useful.

Sterically hindered phenols as described e.g. in U.S. Pat. No. 4,001,026 are examples of such auxiliary reducing agents that can be used in admixture with said organic silver salts without premature reduction reaction and fog-formation at room temperature.

For obtaining a neutral black image tone with silver formed in the higher optical density parts and neutral grey in the lower densities the reducible silver salt(s) and reducing agents are advantageously used in conjunction with a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Particularly useful toning agents are likewise the heterocyclic toner compounds of the benzoxazine dione or naphthoxazine dione type.

In addition to said ingredients one or more of the imaging layers and the protective layer of the recording material may contain other additives such as antistatic agents, e.g. non-ionic antistatic agents including a fluorocarbon group as in $F_3C(CF_2)_6CONH(CH_2CH_2O)$—H, ultra-violet absorbing compounds, and/or optical brightening agents.

According to the present invention an image can be obtained by image-wise heating the above defined recording materials while moving the recording material with the already defined heat-sensitive side in contact with a stationary thermal head. The recording material locally reaches a temperature of up to 400° C. by varying the number of heat pulses given off by the thermal head. By varying the number of heat pulses the density of the corresponding image pixel is varied correspondingly.

The present invention will now be illustrated by the following examples without however the intention to limit the invention thereto. All parts are by weight unless otherwise specified.

EXAMPLE 1

A subbed polyethylene terephthalate support having a thickness of 100 μm was doctor blade-coated so as to obtain thereon after drying the following recording layer containing:

| | |
|---|---|
| silver behenate | 4.31 g/m² |
| polyvinyl butyral | 2.15 g/m² |
| behenic acid | 0.43 g/m² |
| indane I (reducing agent R) | 1.64 g/m² |
| 3,4-dihydro-2,4-dioxo-1,3,2H-benzoxazine | 0.31 g/m² |

After drying said recording layer was coated at 22° C. at wet coating thickness of 25 μm with the following coating composition for forming an outermost UV-curable resin layer.

| | |
|---|---|
| methyl ethyl ketone | 98.5 g |
| 1,6-hexanediol diacrylate | 0.43 g |
| EBECRYL 264 (tradename) as defined hereinafter | 1.99 g |
| DAROCURE 1173 (tradename) as defined hereinafter | 0.07 g |

EBECRYL 264 is a tradenee of Union Chimique Belge S.A. for an aliphatic urethane acrylate oligomer dissolved in 1,6-hexane diol diacrylate (HDDA) in a 85/15 ratio and having a Hoeppler viscosity of about 45,000 mPa.s.

DAROCUR 1173 is a tradename of E. Merck, Darmstadt, Germany for 2-hydroxy-2-methyl-1-phenyl-propan-1-one.

The coated layer was dried for 10 min in an air current at 50° C.

After drying the layer is UV-cured using a Labcure Unit (supplied by Technigraf GmbH, Grävenwiesbach, Germany) operating with air cooling, energy output of 80 W/cm, and a velocity of throughput of 6 m/min at a distance of 11 cm from the UV radiation source.

The thus obtained recording material was used in a thermal printer MITSUBISHI CP100 (tradename). During printing the printhead was kept in contact with the outermost UV-cured coating. No signs of image deformation and no white lines in black area were detected.

The optical densities of the imaged and non-imaged areas were measured in transmission with densitometer MACBETH TD 904 (tradename) provided with an ortho filter (maximal transmission at about 500 nm). The measured minimum optical density ($D_{min}$) was 0.06 and the maximum optical density ($D_{max}$) was 2.6.

EXAMPLE 2

A subbed polyethylene terephthalate support having a thickness of 100 μm was doctor blade-coated so as to obtain thereon after drying the following heat-sensitive imaging layer including:

| | |
|---|---|
| silver behenate | 4.42 g/m² |
| polyvinyl butyral | 4.42 g/m² |
| reducing agent R as defined hereinafter | 0.84 g/m² |
| 3,4-dihydro-2,4-dioxo-1,3,2H-benzoxazine | 0.34 g/m² |
| silicone oil | 0.02 g/m² |

Reducing agent R is 1,1'-spirobi(1H-indene)-5,5',6,6'-tetrol-2,2',3,3'-tetrahydro-3,3,3', 3'-tetramethyl.

Onto the heat-sensitive layer was coated a protective layer having the following composition:

2 parts of a solution in water containing 7% of polyvinyl alcohol (POLYVIOL W48/20 tradename from Wacker) were mixed with 1 part of an aqueous solution containing 14% of tetramethyl orthosilicate. The mixture was brought to pH=4 using sodium hydroxide.

The obtained solution was coated with a Braive knife of 50 μm to the heat-sensitive layer. The obtained recording material was dried and heated for 1 hour at 60° C. to harden the protective layer.

The recording material was then used in thermal printing as described in Example 1. Neither white lines nor uneveness in density in large black area were detected after recording of several succeeding images.

EXAMPLES 3, 4, 5, and 6

Example 1 was repeated but therein the coating composition of the protective layer composition was replaced respectively by: solvent-containing coating compositions 3, 4, 5, and 6:

| | |
|---|---|
| Coating composition 3 | |
| methyl ethyl ketone | 89.4 g |
| EBECRYL 624 (tradename) as defined hereinafter | 10.0 g |
| DAROCURE 1173 (tradeflame) as defined hereinafter | 0.5 g |
| EBECRYL 350 (tradename) as defined hereinafter | 0.1 g |
| Coating composition 4 | |
| methyl ethyl ketone | 89.4 g |
| EBECRYL 810 (tradename) as defined hereinafter | 10.0 g |
| DAROCURE 1173 (tradename) as defined hereinafter | 0.5 g |
| EBECRYL 350 (tradename) as defined hereinafter | 0.1 g |
| Coating composition 5 | |
| methyl ethyl ketone | 89.4 g |
| EBECRYL 1290 (tradename) as defined hereinafter | 10.0 g |
| DAROCURE 1173 (tradename) as defined hereinafter | 0.5 g |
| EBECRYL 350 (tradename) as defined hereinafter | 0.1 g |
| Coating composition 6 | |
| methyl ethyl ketone | 89.4 g |
| JAYLINK 106E (tradename) as defined hereinafter | 10.0 g |
| DAROCURE 1173 (tradename) as defined hereinafter | 0.5 g |
| EBECRYL 350 (tradename) as defined hereinafter | 0.1 g |

EBECRYL 624 is a tradename of Union Chimique Belge S.A. for an aromatic epoxy acrylate dissolved in 1,6-hexane diol diacrylate in a 90/10 ratio.

EBECRYL 350 is a tradename of Union Chimique Belge S.A. for a silicone diacrylate with a Hoeppler viscosity of 250 mPa.s at 25° C.

EBECRYL 810 is a tradename of Union Chimique Belge S.A. for a polyester tetraacrylate (Hoeppler viscosity of 500 mPa.s at 25 ° C.).

EBECRYL 1290 is a tradename of Union Chimique Belge S.A. for a hexafunctional aliphatic urethane acrylate with a Hoeppler viscosity of 2000 mPa.s at 25° C.

JAYLINK 106E is a tradename of Bomar Specialties Company for a modified cellulose acetate butyrate containing acrylamidomethyl groups (vinyl substitution-degree 0.2).

The above mentioned coating compositions 3, 4, 5 and 6 were coated onto the thermosensitive layer at a temperature of 30° C. and wet coating thickness of 50 μm. The coated layers were dried at the air for 10 minutes at 50° C. and UV cured as described in Example 1, but passed twice under the UV-source at a through-put speed of 10 m/min.

Neither white lines nor uneveness in optical density in large black area were detected after recording of several succeeding images, proving a very good abrasion-resistance.

EXAMPLES 7, 8 and 9

Example 1 was repeated but therein the coating composition of the protective layer composition was replaced respectively by: solvent-free coating compositions 7, 8 and 9:

| | |
|---|---|
| Coating composition 7 | |
| EBECRYL 624 (tradename) as defined already | 60.0 g |
| HDDA | 25.0 g |
| Methyl benzophenone | 5.0 g |
| EBECRYL P115 (tradename) as defined hereinafter | 10.0 g |
| EBECRYL 350 (tradename) as defined already | 5.0 g |
| Coating composition 8 | |
| EBECRYL 624 (tradename) as defined already | 35.0 g |
| HDDA | 50.0 g |
| Methyl benzophenone | 5.0 g |
| EBECRYL P115 (tradename) as defined hereinafter | 10.0 g |
| EBECRYL 350 (tradename) as defined already | 5.0 g |
| Coating composition 9 | |
| EBECRYL 624 (tradename) as defined already | 25.0 g |
| HDDA | 60.0 g |
| Methyl benzophenone | 5.0 g |
| EBECRYL P115 (tradename) as defined hereinafter | 10.0 g |
| EBECRYL 350 (tradename) as defined already | 5.0 g |

EBECRYL P115 is a tradename of Union Chimique Belge S.A. for a copolymerisable tertiary amine with Hoeppler viscosity of 20 mPa.ss at 25° C.

The above mentioned coating compositions 7 to 9 were coated onto the thermosensitive layer at a coating thickness of 4 μm. The coated layers were UV cured as described in Example 1, but passed twice under the UV-source at a through-put speed of 10 m/min.

Neither white lines nor uneveness in optical density in large black area were detected after recording of several succeeding images, proving a very good abrasion-resistance.

We claim:

1. A method of recording an image by image-wise heating a recording material, said recording material comprising on the same side of a support, called the heat-sensitive side, (1) one or more layers comprising an imaging composition consisting essentially of (i) a substantially light-insensitive organic silver salt being in thermal working relationship with (ii) a reducing agent, and (2) at same said side covering said imaging composition a protective layer, characterized in that the image-wise heating proceeds with a thermal head contacting said heat-sensitive side and through said protective layer mainly comprising an organic thermosetting or moisture-hardened polymer or an organic thermosetting or moisture-hardened polymer composition.

2. Method according to claim 1, wherein said protective layer has been formed by means of (a) polymer(s) chemically crosslinked at a temperature below the formation of unacceptable fog in the recording layer.

3. Method according to claim 1, wherein said protective layer contains hydrophilic polymers having active hydrogen atoms at least part of which has reacted with hardening agents selected from the group consisting of polyisocyanates, polyepoxides and aldehydes.

4. Method according to claim 1, wherein said hydrophilic polymer are selected from the group consisting of polyvinyl alcohol, partially hydrolyzed polyvinyl acetate, and gelatin.

5. Method according to claim 1, wherein said protective layer contains a polymer composition hardened under the influence of moisture and prepared by mixing the following components (A) and (B):

(A) 30 to 99 parts by weight of at least one copolymer of olefinically unsaturated compounds having a weight-average molecular weight of at least 1500 and containing chemically incorporated moieties capable of undergoing an addition reaction with andno groups, and (B) 1 to 70 parts by weight of organic substances containing blocked amino groups from which substances under the influence of moisture compounds having free primary and/or secondary amino groups are formed, and wherein i) the copolymers of component (A) contain intramolecularly bound carboxylic anhydride moieties, with the anhydride equivalent weight of the copolymers being from 393 to 9,800 and ii) the binder composition contains from 0.25 to 10 anhydride moieties for each blocked amino group.

6. Method according to claim 1, wherein said protective layer contains or has on top a liquid lubricating material.

7. Method according to claim 1, wherein said protective layer has a thickness from 1 to 10 μm.

8. A recording material comprising on the same side of a support, called the heat-sensitive side, (1) one or more layers comprising an imaging composition essentially consisting of (i) a substantially light-insensitive organic silver salt being in thermal working relationship with (ii) a reducing agent, and (2) at said same side covering said imaging composition a protective later, characterized in that said protective layer mainly comprises an organic thermosetting or moisture-hardened polymer or an organic thermosetting or moisture-hardened polymer composition.

9. Material according to claim 8, wherein said protective layer has been formed by means of (a) polymer(s) chemically crosslinked at a temperature below the formation of unacceptable fog in the recording material.

10. Material according to claim 8, wherein said protective layer contains hydrophilic polymers having active hydrogen atoms at least part of which has reacted with hardening agents selected from the group consisting of polyisocyanates, polyepoxides and aldehydes.

11. Material according to claim 10, wherein said hydrophilic polymers are selected from the group consisting of polyvinyl alcohol, partially hydrolyzed polyvinyl acetate, and gelatin.

12. Material according to claim 8, wherein said protective layer contains a polymer composition hardened under the influence of moisture and being prepared by mixing the following components (A) and (B):

(A) 30 to 99 parts by weight of at least one copolymer of olefinically unsaturated compounds having a weight-average molecular weight of at least 1500 and containing chemically incorporated moieties capable of undergoing an addition reaction with amino groups, and (B) 1 to 70 parts by weight of organic substances containing blocked amino groups from which substances under the influence of moisture compounds having free primary and/or secondary amino groups are formed, and wherein i) the copolymers of component (A) contain intramolecularly bound carboxylic anhydride moieties, with the anhydride equivalent weight of the copolymers being from 393 to 9,800 and ii) the binder composition contains from 0.25 to 10 anhydride moieties for each blocked amino group.

13. Material according to claim 8, wherein said protective layer contains or has on top a lubricating material and/or contains particulate anti-friction material.

14. Material according to claim 8, wherein said protective layer has a thickness from 1 to 10 μm.

* * * * *

UNITED STATES PATENT AND TRADEMARK OFFICE

CERTIFICATE OF CORRECTION

PATENT NO. : 5,710,095

DATED : January 20, 1998

INVENTOR(S) : Horsten et al.

It is certified that error appears in the above-identified patent and that said Letters Patent is hereby corrected as shown below:

Title page 7th line of ABSTRACT, "later" should read -- layer--;

Column 9, line 17, delete "U.S. Pat. No.";

Column 16, line 16, "1.99 g" should read --1.00 g--;

Column 17, line 17, "(tradeflame" should read --(tradename)--.

Signed and Sealed this

Eleventh Day of May, 1999

*Attest:*

Q. TODD DICKINSON

*Attesting Officer*

*Acting Commissioner of Patents and Trademarks*